US005927235A

United States Patent [19]

Olaiz

[11] Patent Number: 5,927,235

[45] Date of Patent: Jul. 27, 1999

[54] KID-KEEPER CHILD HARNESS AND DETACHABLE TETHER

[75] Inventor: James Olaiz, Huntington Beach, Calif.

[73] Assignee: Junior Products, Inc., Santa Ana, Calif.

[21] Appl. No.: 09/058,011

[22] Filed: Apr. 9, 1998

[51] Int. Cl.[6] ..... A62B 35/00

[52] U.S. Cl. ..... 119/770; 119/857; 182/3

[58] Field of Search ..... 119/770, 857; 182/3; 244/151 R

[56] References Cited

U.S. PATENT DOCUMENTS

| | | | |
|---|---|---|---|
| 3,022,855 | 2/1962 | Lewis | 182/3 |
| 3,448,826 | 6/1969 | Rosenblum | 182/3 |
| 4,666,017 | 5/1987 | Zimmerman . | |
| 5,325,818 | 7/1994 | Leach . | |
| 5,540,188 | 7/1996 | Heinrichs . | |
| 5,664,844 | 9/1997 | Greene | 297/485 |
| 5,676,426 | 10/1997 | Herring | 297/484 |

*Primary Examiner*—Robert P. Swiatek
*Assistant Examiner*—Son T. Nguyen
*Attorney, Agent, or Firm*—Price Gess & Ubell

[57] ABSTRACT

A child harness and tether is provided having superior comfort and safety features, the tether comprising a detachable strap adjustable in length and connectable to a harness using a tangle resistant rotating clasp where the position of the connection is away from the child's waist area to prevent undo stress or injury. The harness is fully adjustable to accommodate children of various sizes and utilizes Velcro® type fasteners at the waistband adjustment for a proper, easy fit. A pair of shoulder straps connect in the back of the child at a vertical flap which extends from the waistband, and connect in front of the child to the waistband in a sliding relationship. Both shoulder straps forms loops to capture the waistband while permitting the shoulder straps, which are joined together, to move along the waistband for greater flexibility. Strategically placed pads on the shoulder straps protect and comfort the child in the harness, and the connection of the tether to the harness is located at a point intermediate between the waistband and the top of the shoulders to reduce stress on the child's lower back and distribute the force from the tether to the torso where it is more easily received.

5 Claims, 3 Drawing Sheets

KID-KEEPER CHILD HARNESS AND DETACHABLE TETHER

BACKGROUND OF THE INVENTION

1. Field of the Invention

The invention relates generally to parental safety equipment, and more particularly to an improved child safety harness and adjustable tether providing improved comfort and safety for the child and greater reliability.

2. Description of Related Art

Small children have an innate curiosity about strange and new environments which may cause them to wander or explore. Uninhibited, children will seek out anything which catches their attention, or may simply wander about without the attention that an adult is aware of. The preoccupied or curious child can sometimes wander into harms way in an otherwise innocuous environment for adults. For this reason, parents or caregivers in charge of small children must constantly be aware of their charges at all times. This task is difficult if the adult is has no other responsibilities, but may border on the impossible if the adult is trying to divide its attention between the child and other matters. The situation is further complicated by the presence of crowds such as one might find in a shopping center, grocery store, little league game, and so on.

To assist the parent in controlling and protecting the child, it is known to connect the child via a tether so as to limit the child's exploration to a manageable area. These tethers can relieve the parent of carrying the child in dangerous areas such as crossing a busy street or passing a fountain, and can thus serve as a considerable aid to the parent. However, tethers of the art also suffer drawbacks in the safety and comfort of the child, which can either injure the child or cause the child to resist wearing the tether. These drawbacks are especially prevalent when combined with a designated harness for use with the tether. For example, see Zimmermann U.S. Pat. No. 4,666,017 and Leach U.S. Pat. No. 5,325,818. Harness and tether combinations heretofore have been designed with shoulder straps fixed to a waistband in the front which may cause the harness to twist, bind, and even slip off the child. Furthermore, the harnesses typically lack padding to protect the child and connect to the tether in a way which permits tangling, and the point of contact is typically too low placing undo stress on the child's sensitive lower back, subjecting the child to a greater risk of injury.

OBJECTS AND SUMMARY OF THE INVENTION

In view of the shortcomings of the prior art, it is a first object of the present invention to provide a child harness and tether which provides improved comfort for the child by connecting the tether in a more ergonomically friendly manner.

Another object of the present invention is to provide a child harness and tether which permits flexibility, and thus improved comfort, at the waistband/shoulder strap connection.

Another object of the present invention is to provide a tether and harness connection which resists tangling.

Another object of the present invention is to improve comfort through the use of strategically placed padding.

BRIEF DESCRIPTION OF THE DRAWINGS

The exact nature of this invention, as well as its objects and advantages, will become readily apparent upon reference to the following detailed description when considered in conjunction with the accompanying drawings, in which like reference numerals designate like parts throughout the figures thereof, and wherein.

DESCRIPTION OF THE PREFERRED EMBODIMENTS

The following description is provided to enable any person skilled in the art to make and use the invention and sets forth the best modes contemplated by the inventors of carrying out their invention. Various modifications, however, will remain readily apparent to those skilled in the art, since the general principles of the present invention have been defined herein specifically to provide a child harness and tether with greater safety and comfort.

Figure 1:
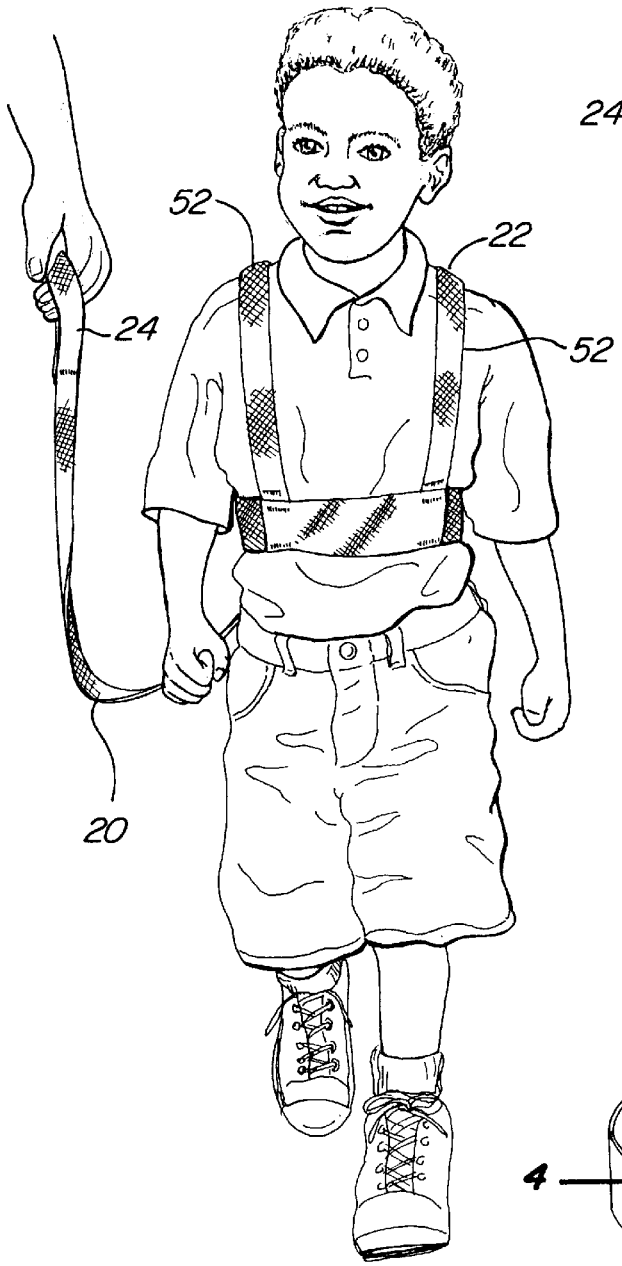
FIG. 1 is a front view of a preferred embodiment of the present invention applied to a small child.

The present invention is a tether 20 and harness 22 for a small child as generally depicted in FIG. 1. As will be described more fully below, the tether 20 is detachable and adjustable in length to give the user more control over the child's range of travel. The tether 20 preferably is made of an elongate flexible strap of brightly colored material terminating at a first end in a loop 24 or handle for easy grasping. The tether 20 should be of a material having sufficient strength and durability so as not to fray, break, or tear under ordinary use. A ring 26 mounted at the first end 28 can be used to secure the tether to a shopping cart, the user, a stationary object and the like should the user require the need for both hands or need to leave the child temporarily unintended or focus her attention on another matter. As shown more particularly in FIG. 2, the tether 20 includes a buckle 30 which secures the second end of the strap and provides a convenient means for shortening or enlarging the length of the tether 20. In this manner, the tether 20 can be adjusted to any desired length less than its original length thereby permitting the user to set the tether length to meet the needs of the present situation. The buckle 30 also forms a second loop 32 at the connection end 34 of the tether 20 from which a clasp 36 is mounted, the clasp 36 having a slot 38 at a base portion 40 that allows it to slide freely along the second loop 32. The clasp 36 further comprises a hook 42 and a flexible latch 44 assembly where the latch 44 is biased in the closed position but may be opened using digital pressure. The hook 42 and latch 44 assembly are journaled within the base portion 40 via an axle extending from the hook and latch assembly into the base portion so that the hook 42 and latch 44 will rotate freely with respect to the base portion 40. This free rotation of the clasp 36, and thus the tether 20, resists tangling as the tether 20 can unwind more easily.

Figure 3:
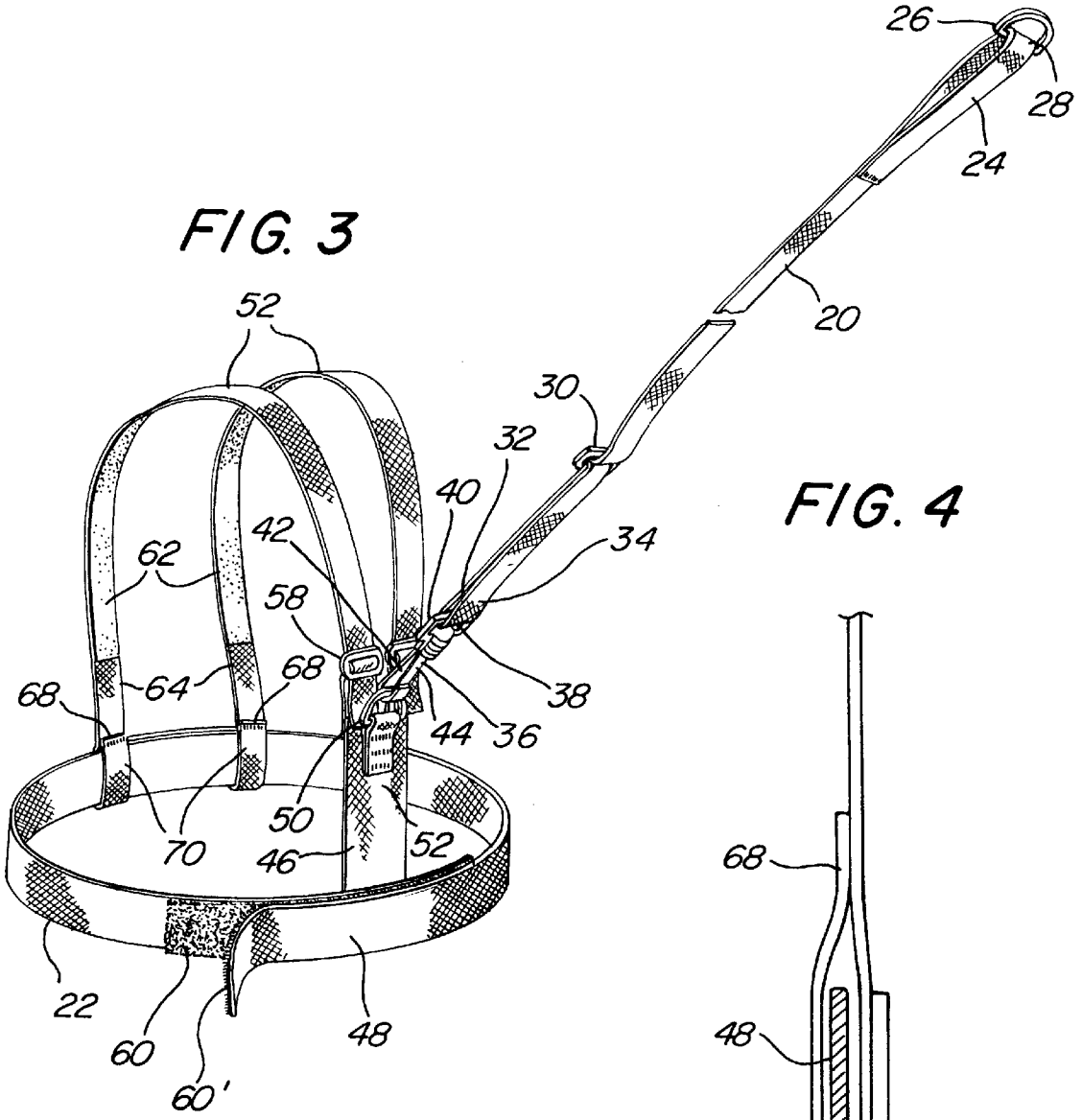
FIG. 3 is a rear elevated perspective view of a preferred embodiment of the present invention illustrating the tether/harness connection.

The tether 20 releasably attaches to the harness 22 at a flap 46 extending vertically from the waistband 48 as shown in FIG. 3. The flap 46 is preferably sewn directly to the waistband 48 to provide a stable and reliable connection. The flap 46 preferably will have a ring 50 connected to its outside surface from which the clasp 36 on the tether 20 can easily connect, where the location of the ring 50 is approximately four to five inches above the waistband 48. The point of connection, i.e. the location of the ring 50, should coincide with a position at least a third of the distance up, and preferably closer to the midpoint or higher, of the child's back between the top of the waistband 48 and the neck so that the force from the tether 20 is not focused on the waist or lower back of the child. Rather, by adjusting the shoulder straps 52 and using a ring placement higher on the flap 46, the force is relocated to the torso which can better withstand the stresses. Similarly, the connection point should be at least a third of the distance down from the child's neck to avoid injuries to the neck and spine. Moreover, the adjustable nature of the harness 22 permits a greater fit of the child, which in turn promotes a distribution of the forces along the shoulders and the entire torso rather than a localized application of force. This distribution of forces reduces the strain on the child's back and improves the safety and comfort of the harness.

The flap 46 terminates at its upper edge 54 by dividing into a "V" configuration, the prongs 56 forming the attachment points of the two shoulder straps 52. Each prong 56 of the V includes a releasable fastener 58 such as a buckle or the like which can adjustably connect the shoulder strap 52 in a convenient and expeditious manner.

The waistband 48 preferably includes a fastening system of hooks 60 and loops 60' such as that under the Velcro® trademark, where a first contact surface is placed on the outer surface of a first end and a second contact surface is placed on the inner surface of the second end. The hooks 60 and loops 60' permit adjustment of the waistband 48 to the preferred dimensions in a quick and easy way, although any other suitable fastening system can be substituted.

Figure 2:
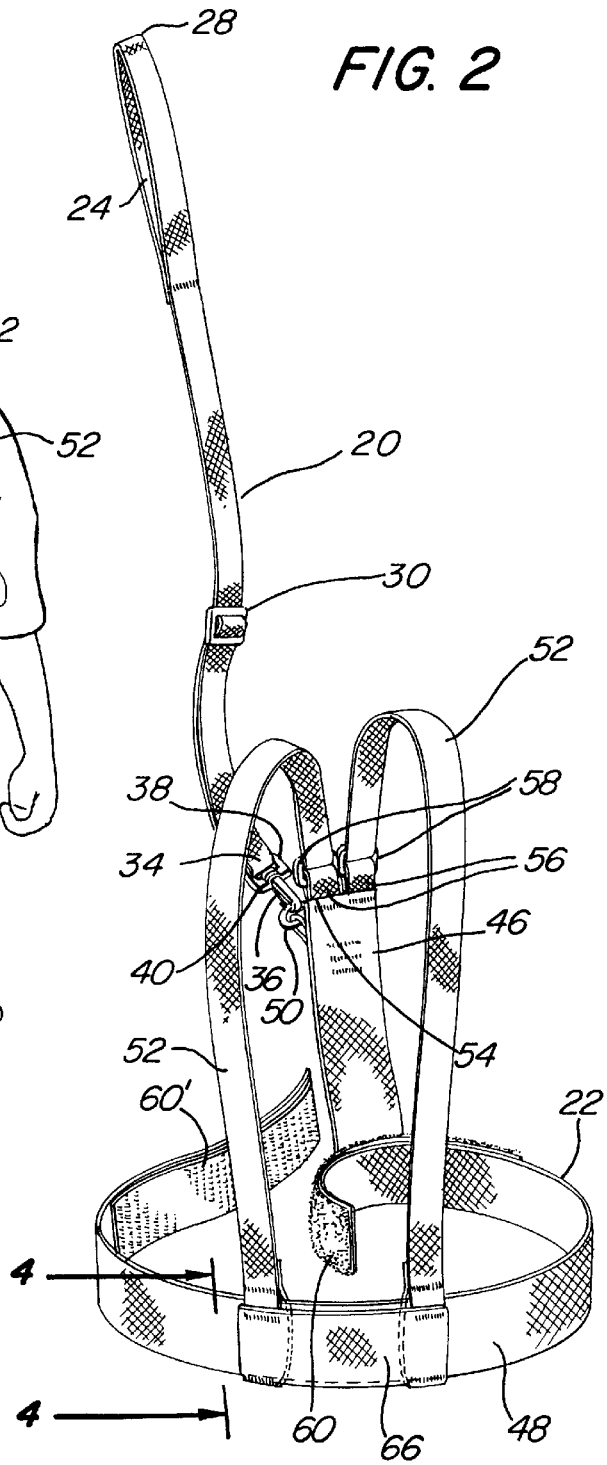
FIG. 2 is a front elevated view of a preferred embodiment of the present invention.
Figure 4:
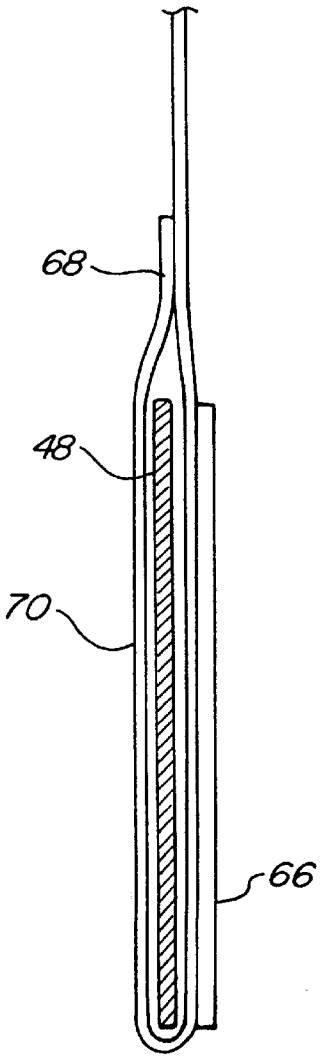
FIG. 4 is a cross sectional view taken from FIG. 2 illustrating the connection at the waistband and shoulder strap.

The pair of shoulder straps 52 secure the child in the harness 22 as shown in FIG. 2, where each shoulder strap 52 is connected to a prong 56 of the V shaped end of the flap 46. The shoulder straps 52 include pads 62 on the inner surface 64 (see FIG. 3) at the location of contact with the child's shoulders to protect the child's sensitive skin and provide improved comfort. The shoulder straps 52 attach to the waistband 48 in the front of the child in a unique way which further promotes the comfort of the child. The shoulder straps 52 are connected to a transverse strap 66 and the ends 68 of each shoulder strap 52 further form a pair of spaced apart loops 70. The loops 70 are sized to fit the waistband 48 much like a belt loop on a pair of pants. As shown in FIG. 4, the loops completely receive the waistband 48 with enough play to permit the loops 70 and transverse flap 66 to slide along the waistband 48. The loops 70 are spaced apart by a distance of two and a half to three and a half inches and thus the transverse strap 66 and the shoulder straps 52 can travel together along the waistband 48 as necessary to prevent pinching, twisting, and the like. A child in a comfortable harness is less likely to fuss or try to remove the harness and thus safety is improved also.

Figure 5:
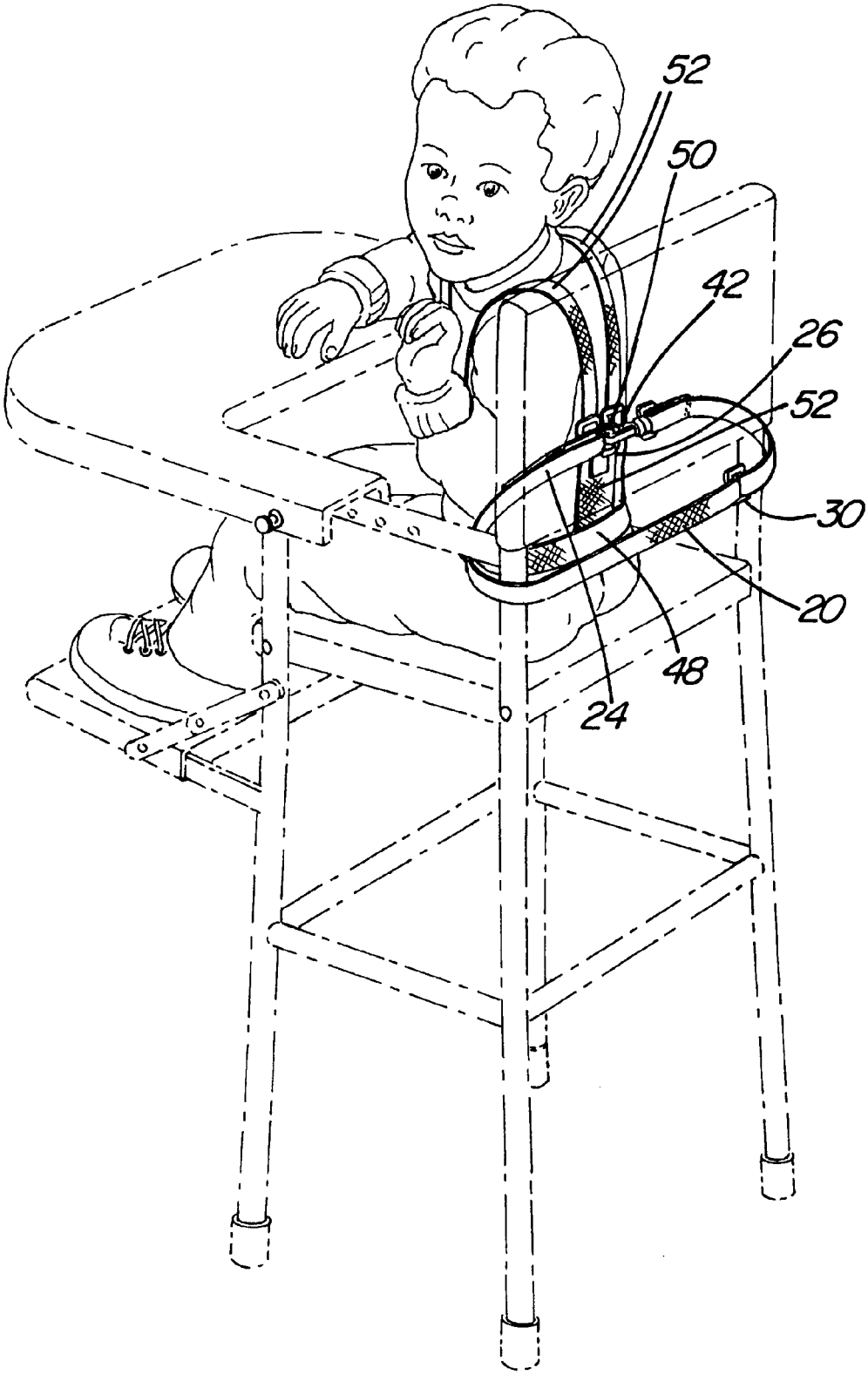
FIG. 5 is an elevated perspective view of the present invention operating as chair restraint.

Another important feature of the present invention is illustrated in FIG. 5, where a child is shown seated in a highchair. While wearing the harness, the tether 20 can be looped around the back of the chair such that the ring 26 reattaches to the hook 42 and latch assembly 44, forming a closed loop as shown. By adjusting the length of the tether via the buckle 30, the child can now be safely secured in the chair thus reducing the risk of falling or sliding out. While a highchair is shown, it can easily be seen that the present invention can be used to secure a child to various types of chairs and the like. Furthermore, by using the back of the chair for restraint, the child's back and neck are more properly supported.

The harness 22 described can be made of lightweight, machine washable materials which can be easily stowed in the glove box of a car or in a purse. Those skilled in the art will appreciate that various adaptations and modifications of the just-described preferred embodiment can be configured without departing from the scope and spirit of the invention. Therefore, it is to be understood that, within the scope of the appended claims, the invention may be practiced other than as specifically described herein.

What is claimed is:

1. A tether and harness for a child comprising:

a tether comprising an elongate strap which is adjustable in length and includes a handle at a first end and a clasp generally at a second end, said clasp releasably mountable to a connection point on said harness, said clasp including a base portion mountable to said strap and a hook portion connectable to said harness, said hook portion rotating freely with respect to said base portion; and a harness comprising:

a pair of shoulder straps each connected at first ends to a transverse strap, the connection between said first ends of said shoulder straps and said transverse strap including a pair of spaced apart loops, said shoulder straps each further comprising a padded region at a corresponding shoulder position of the child;

an adjustable waistband passing through said pair of loops to secure said shoulder straps in front of the child while permitting the transverse strap to slide along said waistband; and a flap extending vertically from said waistband at a first end and terminating in a V section at a second end, each prong of said V section including a releasable fastener connecting one of said pair of shoulder straps, said flap further comprising the point of connection with said tether where said connection point is located at least a third of a distance up between the waistband and the child's neck.

2. The tether and harness of claim 1 wherein the adjustable waistband includes opposed regions of hooks and loops to adjustably fasten the waistband.

3. The tether and harness of claim 1 further comprising a ring at the first end of said tether for securing the tether to a stationary object.

4. The tether and harness of claim 1 wherein said connection point of said tether on said flap is located at least a third of a distance down between the waistband and the child's neck.

5. The tether and harness of claim 1 further comprising a ring on the first end of said tether, said tether securing a child to a chair by wrapping around a back of the chair and said ring attaching to said hook portion such that said tether forms a closed loop around the back of the chair.

* * * * *